US009803330B2

(12) United States Patent
Seay

(10) Patent No.: US 9,803,330 B2
(45) Date of Patent: Oct. 31, 2017

(54) POST SUPPORT AND POST SUPPORT SYSTEM

(71) Applicant: Timothy Seay, Lynchburg, VA (US)

(72) Inventor: Timothy Seay, Lynchburg, VA (US)

( * ) Notice: Subject to any disclaimer, the term of this patent is extended or adjusted under 35 U.S.C. 154(b) by 0 days.

(21) Appl. No.: 14/877,169

(22) Filed: Oct. 7, 2015

(65) Prior Publication Data

US 2017/0101760 A1 Apr. 13, 2017

(51) Int. Cl.

| | |
|---|---|
| ***E02D 27/42*** | (2006.01) |
| ***E04H 12/22*** | (2006.01) |
| ***E02D 27/01*** | (2006.01) |

(52) U.S. Cl.

CPC ..... *E02D 27/42* (2013.01); *E02D 27/01* (2013.01); *E02D 27/013* (2013.01); *E02D 27/016* (2013.01); *E04H 12/2246* (2013.01); *E04H 12/2269* (2013.01)

(58) Field of Classification Search

CPC . E04B 1/40; E04B 2001/405; E04H 12/2253; E04H 12/2269; E04H 12/2238; E04H 12/22; E04H 12/2246; E02D 27/42; E02D 27/016; E02D 27/013; E02D 27/01

See application file for complete search history.

(56) References Cited

U.S. PATENT DOCUMENTS 76,515 A * 4/1868 Patton ..... E04H 12/2269 52/298
90,611 A * 5/1869 Unger ..... E04H 12/2269 52/298
284,219 A * 9/1883 Mehew ..... E04H 12/2215 52/154
1,568,777 A * 1/1926 Smith ..... E04H 12/2269 52/146
3,342,444 A 9/1967 Nelson
3,918,229 A * 11/1975 Schweinberger ..... E02D 27/14 52/295
4,387,543 A * 6/1983 Tschan ..... E04H 12/2253 52/295
4,924,648 A * 5/1990 Gilb ..... E04B 1/41 52/295

(Continued)

FOREIGN PATENT DOCUMENTS

FR 2849120 A1 * 6/2004 ..... A62B 35/0056
SE WO 2011112142 A1 * 9/2011 ..... E04H 12/2223
WO WO 2015047209 A1 * 4/2015 ..... E02D 27/42

*Primary Examiner* — Adriana Figueroa
*Assistant Examiner* — Jessie Fonseca
(74) *Attorney, Agent, or Firm* — New River Valley IP Law, PC; Michele L. Mayberry

(57) ABSTRACT

A post support system is provided that is useful for construction projects where supports are placed in the ground and the supports and their placement in the ground can be inspected at any time during construction. This allows for construction to continue on the project without being held up for inspection purposes. Provided is a post support system comprising: a post support with a base; at least two walls opposing one another on one side of the base; a plate with apertures on an opposing side of the base; and at least three legs, each with a first end disposed in communication with one of the apertures of the plate; and a support mount with a lip; wherein each leg has a second end disposed in communication with the lip of the support mount.

18 Claims, 6 Drawing Sheets

(56) References Cited

U.S. PATENT DOCUMENTS

| | | | | | |
|---|---|---|---|---|---|
| 4,995,206 | A * | 2/1991 | Colonias | E04H 12/2253 | 52/298 |
| 5,123,623 | A * | 6/1992 | McNamara | E04H 12/2253 | 248/156 |
| 5,203,817 | A | 4/1993 | Klumpjan | | |
| 5,307,603 | A * | 5/1994 | Chiodo | E04B 1/2608 | 52/297 |
| 5,375,384 | A * | 12/1994 | Wolfson | E04B 1/0007 | 52/295 |
| 5,456,441 | A * | 10/1995 | Callies | E04H 12/2253 | 248/521 |
| 5,561,950 | A * | 10/1996 | Collins | E02D 27/32 | 248/354.3 |
| 6,371,432 | B1 * | 4/2002 | Tsappi | A01G 9/124 | 248/158 |
| 6,461,084 | B1 | 10/2002 | Stuart | | |
| 7,444,787 | B2 | 11/2008 | Cutforth | | |
| 7,942,612 | B1 | 5/2011 | Willison | | |
| 8,584,413 | B1 | 11/2013 | Keller | | |
| 2004/0159055 | A1 * | 8/2004 | Stone | E02D 5/80 | 52/153 |
| 2008/0017226 | A1 * | 1/2008 | Nobert | E04H 12/2215 | 135/16 |
| 2012/0085050 | A1 * | 4/2012 | Greenwood | E04B 1/41 | 52/296 |
| 2013/0312340 | A1 | 11/2013 | Miller et al. | | |
| 2014/0373461 | A1 | 12/2014 | Rodriguez | | |
| 2015/0159337 | A1 * | 6/2015 | Kellner | F03D 11/045 | 248/156 |

* cited by examiner 1
11
15
14
20
21

1
15
14
20
21

17
15

12

11

11
12
20

17
15

12
11

12
11

2
31
30
11
15
14

30

2
15
14
30
31

30

30

POST SUPPORT AND POST SUPPORT SYSTEM

FIELD OF THE INVENTION

The present disclosure relates to the field of post supports/braces for poured concrete footings. More particularly, the present disclosure relates to post supports and systems which allow for continuous project advancement while waiting for formal post-hole/footing inspection and approval. The post supports and systems are designed so that a concrete footing can be poured after a post-supported structure is already built.

BACKGROUND OF THE INVENTION

During construction projects, posts, when anchored to poured concrete footings, are often required to maintain structural integrity and to distribute loads. Posts are usually secured and set on a poured concrete footing in a hole of sufficient depth and width to provide the post with adequate support such that the post can perform its intended purpose. Typically the hole is excavated, inspected for proper soil bearing and depth, concrete is poured into the hole, and a post anchor is set in the wet concrete prior to securing a post to the post anchor. This is done to provide adequate bearing and uplift resistance for the structure being supported.

Current footing methods found in the art are not designed to take into account the valuable project time lost when construction is halted to wait for those tasked with inspecting the holes and pouring the concrete footings to perform their duties. For instance, U.S. Pat. No. 8,584,413 discloses an anchor device having a plurality of teeth protruding from planar surfaces configured for placement adjacent to the post. Similarly, U.S. Pat. App. Pub. No. 2013/0312340 discloses a subterranean support structure having a tube extension adapted for placement within a hole to receivingly nest a proximal end of a vertically extending post that extends above the hole. Further, U.S. Pat. No. 7,942,612 discloses a post hole shoring device for receiving and securing a vertically extended 4×4 post. A need exists for a post support which can support a post and allow workers to continue working on a construction project during the open hole inspection and concrete placement process.

SUMMARY OF THE INVENTION

The present disclosure provides a post support and a system for supporting a post adequately so that construction may proceed while waiting for footing inspection and concrete footing placement. Embodiments of the present disclosure provide a system that can be placed into an open hole for support of a post, or a post and its accompanying loads, which allows workers to continue with a construction project while open hole inspections are scheduled and performed. In embodiments, following passage of the inspection, the post support system remains in place, continues to support the post, and is buried when the open hole is filled with concrete.

Embodiments of the disclosure provide a post support for insertion into an open hole, which post support comprises a base, at least two walls disposed on the base, and at least three legs disposed directly or indirectly with the bottom surface of the base. The base of the post support includes a top surface and a bottom surface. In embodiments the base and side walls may be provided as a unitary piece, for example, as a U-shaped member.

Such embodiments include a post support system comprising: (a) a U-shaped post support comprising: (i) a base plate with a top surface and a bottom surface; and (ii) at least two walls opposing one another; (b) at least three legs; and (c) a support mount for receiving the at least three legs of the post support; wherein a first end of each of the at least three legs is disposed in direct or indirect communication with the base plate and a second end of each of the at least three legs is disposed in direct or indirect communication with the support mount.

Embodiments provide a post support wherein the walls are disposed on the sides of the base, and in particular aspects, on opposing sides of the base. The walls can be any shape, however, in certain embodiments, the walls are substantially square or rectangular in shape. In more particular aspects, the walls have the same dimensions as the base of the post support. As a unitary piece, the base and side walls may be formed from a single piece of planar material, bent to the appropriate configuration. The walls may be oriented in any direction, however, in certain embodiments, the walls are oriented in a vertical direction relative to the top surface of the base. The walls may further comprise one or more through-holes, and in certain embodiments, the through-hole(s) of one wall align with the though-hole(s) of an opposing wall. Alternatively, or in addition, any one or more or all of the through-holes of one side may be disposed offset relative to any one or more or all of the through-holes of the opposing side. The through-holes are used for securing means, such as nails or screws, to pass through the side walls and into a post supported by the base. Where the through-holes are not aligned from side to side, longer fasteners may be used without the risk of the fasteners of one side interfering with the fasteners of the opposing side when secured into the post.

Embodiments provide a post support wherein the post support has at least three legs. It is important that the post support described herein be sufficiently stable while supporting a post and/or post and the load the post is supporting. In certain embodiments, the legs are spaced equidistantly. In a particular aspect, the post support comprises four legs to provide additional stability. Feet can be attached to one or more or each of the legs, or the legs can be bent to provide for feet. The feet will help keep the legs on the surface of the ground when disposed in the hole and while supporting a post and/or other load.

Further, additional embodiments, provide a post support comprising a plate disposed on the bottom surface of the base. As described herein, the plate can be employed to enhance the overall strength of the post support. The plate can reinforce the base allowing the post support to support larger heavier posts or posts maintaining exceedingly large loads. In embodiments where a plate is envisioned, the legs may be disposed on a surface of the plate or the plate may comprise holes for accommodating one end of each leg.

Additional embodiments provide a system for supporting a post. The system will allow for a footing to be inspected while project construction advances. The system will allow workers to continue working instead of temporarily delaying work to obtain the necessary inspections for the footing. The system comprises a post support and a support mount. The post support comprises a base, at least two walls disposed vertically on opposing sides of the base, and at least three legs disposed on a bottom surface of the base. The support mount comprises a hollow frame having a lip/shelf disposed on the interior surface of the frame for receiving the at least three legs of the post support. In particular embodiments, the support mount is a substantially circular frame. In other embodiments, the support mount can be triangular, square or rectangular. Such a configuration provides inspectors with ample opportunity to inspect the footing, for example, with the post support disposed in a hole not yet filled with concrete, without delaying the progress of the construction project.

Also included is a method of construction comprising: installing a frame of a structure; excavating a hole adapted to receive a post for supporting the frame; placing a post support system into the hole; installing the post so that a first end supports the frame and a second end is supported by the base and two opposed side walls of the post support system; attaching the post to at least one of the opposed side walls; and pouring a concrete footing into the hole around the post support system.

DETAILED DESCRIPTION

Figure 1:
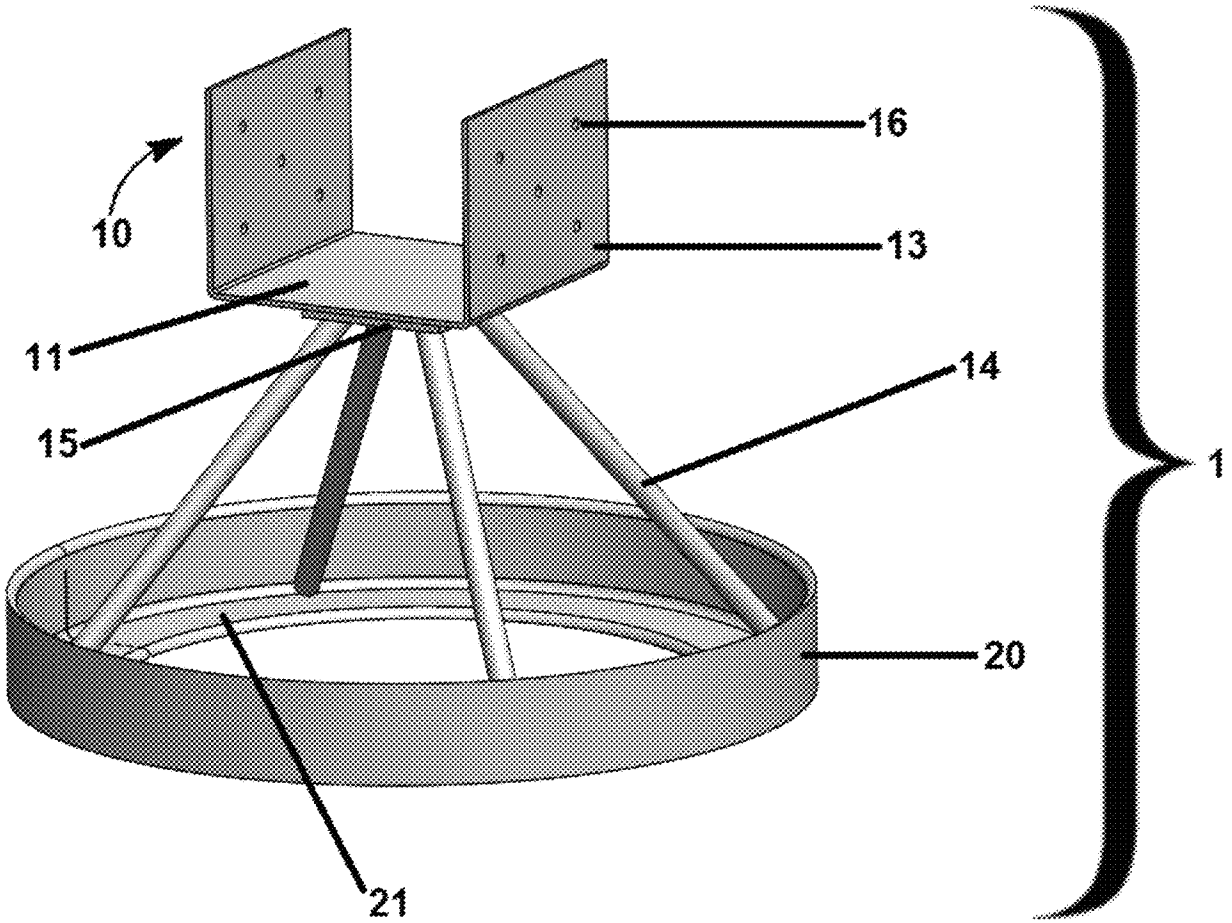
FIG. 1 is a schematic diagram illustrating a post support and post support system according to an embodiment of the disclosure.

In embodiments, the post support system comprises a base comprising at least one plate having at least two side walls disposed perpendicularly or vertically on opposing sides of the base and at least three legs disposed indirectly or directly on a bottom surface of the base and disposed indirectly or directly on a support mount. The support mount comprises a hollow frame having a lip/shelf, which may otherwise be referred to as the base of the support mount, disposed on the interior surface of the frame for receiving the at least three legs of the post support.

Post Support

As provided throughout the specification, the term "post support(s)" as used herein means any structure capable of supporting a post and/or its accompanying load.

In embodiments, the post support has a base, at least two side walls disposed on sides of the base, and at least three legs disposed underneath the base.

In embodiments, the base comprises a top surface for interfacing with a post, a bottom surface (underside) adapted for receiving at least three legs, and at least two sides for communication with at least two walls disposed vertically on opposing sides of the base. The base can be any shape (e.g., U-shaped, trapezoidal, polygonal, such as a triangular, square, rectangular, pentagonal, hexagonal, or octagonal in shape etc.) so long as the shape of the base can adequately support a post and/or a post and its accompanying load and the shape allows the post support to perform its intended function. The base and side walls together can be formed from a single piece of material that is bent into the appropriate configuration, or the base can be joined (such as welded or soldered) to the side walls. In a particular aspect, the shape of the base is substantially square. In an even more particular aspect, the base is substantially square with dimensions ranging from about 1 inch by 1 inch (i.e., 1"×1") to about 20 inches by 20 inches (i.e., 20"×20") (e.g., about 1"×1", 2"×2", 3"×3", 4"×4", 5"×5", 6"×6", 7"×7", 8"×8", 9"×9", 10"×10", 11"×11", 12"×12", 13"×13", 14"×14", 15"×15", 16"×16", 17"×17", 18"×18", 19"×19", up to about 20×20").

In still a more a particular aspect, the base is substantially rectangular in shape with dimensions ranging from about 1 inch by 2 inch (i.e., 1"×2") to about 19 inches by 20 inches (i.e., 19"×20"). In yet an even more particular embodiment, the base is substantially rectangular in shape with dimensions of about 4"×5.50".

Unless otherwise specifically stated, as used herein, the term "about" is understood as within a range of normal tolerance in the art, for example within 2 standard deviations of the mean. The term "about" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about".

The base described herein can be made of any material so long as the material can adequately support a post and/or a post and its accompanying load. Non-limiting examples of acceptable materials for manufacture of the base include metals, alloys, plastics, polymers, woods, combinations of materials comprising metals, alloys, plastics, and/or woods, composite materials, etc. Steel, iron and/or aluminum are specific examples of materials that can be used. Any one or more of the base, side walls, legs, feet, or support mount can be any one or more of these materials.

In a more particular embodiment, the base is manufactured from at least one metallic material. Non-limiting examples of metallic materials acceptable for the manufacture of the base include aluminum, steel, nickel, copper, magnesium, titanium, iron, brass, as well as alloys and combinations thereof and the like. In alternative embodiments, the base is manufactured from at least one plastic material. Non-limiting examples of plastics acceptable for the manufacture of the base include polyolefins, polyesters, nylons, polynylons, vinyls, polyvinyls, acrylics, polyacrylics, polycarbonates, polystyrenes, polyurethanes, as well as combinations thereof, and the like.

Further, an additional plate may be disposed on the bottom surface of the base to enhance the overall strength of the post support. The additional plate can reinforce the base allowing the post support to support larger or heavier posts, or posts maintaining exceedingly large loads. The additional plate can be any shape and can be made of any material so long as the plate is able to enhance the overall strength and load bearing capacity of the post support and/or post support system. Other embodiments may include two, three, four, five, six, or more additional plates for enhancing the strength of the post support. The plate can be planar and the legs welded or soldered to the plate, or the plate can comprise one or more holes, where each hole is shaped, sized and configured for receiving an end of a leg.

The post support further comprises at least two walls disposed on sides of the base. The number of walls can vary and that number is dependent on a number of factors including, but not limited to, the shape of the post, the shape of the base, and the number of walls necessary to fully stabilize the post it is interfacing with. In a particular aspect, the number of walls ranges from two to eight (e.g., three walls, four walls, five walls, six walls, seven walls, up to eight walls). In a particular aspect, the post support has two walls. In a more particular aspect, the post support has two walls disposed on opposing sides of the base. In still a more particular aspect, the post support has two walls disposed on opposing sides of the base, wherein the walls are disposed in a vertical orientation (e.g., the walls are disposed vertically relative to the top surface of the base, the walls are perpendicular to the top surface of the base).

The walls can be any shape (e.g., trapezoidal, polygonal, such as a triangular, square, rectangular, pentagonal, hexagonal, or octagonal in shape etc.) so long as the shape of the walls can adequately support a post and/or a post and its accompanying load and the shape allows the post support to perform its intended function. In a particular aspect, the shape of the walls are substantially square. In an even more particular aspect, the walls are substantially square with dimensions ranging from about 1 inch by 1 inch (i.e., 1"×1") to about 20 inches by 20 inches (i.e., 20"×20") (e.g., about 1"×1", 2"×2", 3"×3", 4"×4", 5"×5", 6"×6", 7"×7", 8"×8", 9"×9", 10"×10", 11"×11", 12"×12", 13"×13", 14"×14", 15"×15", 16"×16", 17"×17", 18"×18", 19"×19", up to about 20×20"). In one aspect, the walls have dimensions substantially the same as the base. In another aspect the walls have dimensions different than the dimensions of the base.

In still a more a particular aspect, the walls are substantially rectangular in shape with dimensions ranging from about 1 inch by 2 inch (i.e., 1"×2") to about 19 inches by 20 inches (i.e., 19"×20"). In yet an even more particular embodiment, the walls are substantially rectangular in shape with dimensions of about 4"×5.50".

Further, the walls can be made of any material so long as the material can adequately support a post and/or a post and its accompanying load. The walls can be made of any of the materials that are also acceptable for the base.

In one aspect, the walls are separate and can be attached to the sides of the base. In another aspect, the base, with the walls disposed thereon, is manufactured in a unitary construction (e.g., a substantially rectangular piece of material with sides folded in an upward direction). In aspects where the walls are separate and attached to the base, any means of attachment may be used so long as the post support is able to perform its intended function. Methods for attaching multiple materials are known in the art. Non-limiting examples include welding, soldering, screwing, riveting, adhesives, etc. In a particular aspect, the walls are welded to the sides of the base.

In aspects where the walls and the base are formed in a unitary construction, any method of unitary or one-piece manufacturing is acceptable. Methods for manufacturing in one-piece formation are known in the art and non-limiting examples of methods for one-piece formation manufacturing include stamping, hydroforming, mold manufacturing (e.g. injection molding, compression molding, cast molding, thermoform molding, etc.), 3-D printing, etc. In particular embodiments, the base and walls are made of a single, continuous piece of material wherein the base comprises walls formed on opposing ends of the base (e.g., the walls are folded in an upward direction) and the dimensions of the base and the walls are substantially the same.

In particular embodiments, the angle formed between a wall and the base is an angle between about 0 degrees and about 180 degrees. For example, the base and side walls can be provided as a planar sheet of material that is bent to provide the side walls at an appropriate angle relative to the base, such as about 5 degrees, 10 degrees, 15 degrees, 20 degrees, 25 degrees, 30 degrees, 35 degrees, 40 degrees, 45 degrees, 50 degrees, 55 degrees, 60 degrees, 65 degrees, 70 degrees, 75 degrees, 80 degrees, 85 degrees, 90 degrees, 95 degrees, 100 degrees, 105 degrees, 110 degrees, 115 degrees, 120 degrees, 125 degrees, 130 degrees, 135 degrees, 140 degrees, 145 degrees, 150 degrees, 155 degrees, 160 degrees, 165 degrees, 170 degrees, 175 degrees, or 180 degrees). In a particular aspect, the angle formed between the walls and the base is about 90 degrees, for example, from about 80-110 degrees.

In certain aspects, each wall may comprise one or more through-holes (i.e., apertures) to further secure the post to the post support with a securing device (e.g., screws, nails, bolts, etc.). In particular aspects, each wall may comprise between one and ten through-holes (e.g., one through-hole, two through-holes, three through-holes, four through-holes, five through-holes, six through-holes, seven through-holes, eight through-holes, nine through-holes, up to ten through-holes). In particular aspects, the through-holes disposed in one wall can align with the through-holes disposed in the opposing wall. In another aspect the through-holes disposed in one wall do not align with the through-holes disposed in the opposing wall, or some may align while others do not align from side to side.

The post support further comprises at least three legs disposed on the bottom surface of the base. The number of legs can vary and that number is dependent on the number of legs necessary to make the post support stable. In a particular aspect, the number of legs ranges from three to ten (e.g., three legs, four legs, five legs, six legs, seven legs, eight legs, nine legs, up to ten legs). In a more particular aspect, the post support has four legs. In particular embodiments, the distance between legs or the angle between the legs is substantially/about equidistant. In other aspects, the distance between legs is not equidistant.

As described herein, the legs can be any shape (e.g., cylindrical, trapezoidal, polygonal, such as a triangular, square, rectangular, pentagonal, hexagonal, or octagonal in shape etc.) and/or size so long as the shape of the legs can adequately support a post and/or a post and its accompanying load when interfacing with the base of the post support. In a particular aspect, the shape of the legs is substantially cylindrical. In certain aspects, each leg may further comprise at least one foot. The foot may operate to add additional stability to the post support where the legs contact a surface or allow for better attachment to the bottom surface of the base. In one aspect, each leg has a single foot. In another aspect each leg has two feet. The foot may be any shape so long as the surface area between the leg and the surface it is interfacing with is greater with at least one foot than a leg not having at least one foot. In other aspects, the legs of the post support may be collapsible (e.g., fold-up and unfold), telescopic, etc. In still other aspects, one or more ends of the legs may be threaded for insertion into the base of the post support.

In a particular aspect, the legs have a length ranging from about 6 inches (i.e., 6") to about 48 inches (i.e., 48") (e.g., about 6", 7", 8", 9", 10", 11", 12", 13", 14", 15", 16", 17", 18", 19", 20", 21", 22", 23", 24", 25" 26", 27" 28", 29", 30", 32", 32", 33", 34", 35", 36", 37", 38", 39", 40", 41", 42", 43", 44", 45", 46", 47", up to about 48"). As described herein, the length of the legs may be fixed or adjustable (e.g., the legs are telescoping legs, etc.). In a particular aspect, the length of the legs is about 9.75". In a more particular aspect, the legs are cylindrical and have a length of about 9.75". In still a more particular aspect, the legs are cylindrical, have at least one foot, and have a length of about 9.75".

Further, the legs can be made of any material so long as the material can adequately support a post and/or a post and its accompanying load when interfacing with the base of the post support. The materials that can be used for the legs and/or feet can be the same as one or more of the materials described above for the base.

In one aspect, the legs may be attached directly or indirectly to the bottom surface of the base. In a more particular aspect, the legs comprise one or more feet which may be attached directly to the bottom surface of the base, and/or the feet may be disposed on an opposing end of the legs to prevent insertion on the legs into the ground on which the device is placed. In another aspect, the legs may be attached directly to a plate which is then further attached to the bottom surface of the base. The legs can also be inserted into apertures in the plate which are shaped, sized and configured for receiving the legs. The legs can be further secured (welded or soldered within the apertures, or screwed into the plate and/or the base) in the apertures.

In embodiments where the legs are attached to a plate, the plate can be any shape (e.g., trapezoidal, polygonal, such as a triangular, square, rectangular, pentagonal, hexagonal, or octagonal in shape etc.) so long as the shape of the plate can adequately support a post and/or a post and its accompanying load and the shape allows the post support to perform its intended function. In a particular aspect, the shape of the plate is substantially square. In an even more particular aspect, the plate substantially square with dimensions ranging from about 1 inch by 1 inch (i.e., 1"×1") to about 20 inches by 20 inches (i.e., 20"×20") (e.g., about 1"×1", 2"×2", 3"×3", 4"×4", 5"×5", 6"×6", 7"×7", 8"×8", 9"×9", 10"×10", 11"×11", 12"×12", 13"×13", 14"×14", 15"×15", 16"×16", 17"×17", 18"×18", 19"×19", up to about 20×20"). In one aspect, the walls have dimensions substantially the same as the base. In another aspect the walls have dimensions different than the dimensions of the base. In a particular aspect, the plate is substantially square with dimensions of about 3"×3".

Any means of attachment may be used to attach the legs to the bottom surface of the base or plate so long as the post support is able to perform its intended function. As described above, methods for attaching multiple materials are known in the art. Non-limiting examples include welding, screwing, riveting, adhesives, etc. In a particular aspect, the legs are welded to the bottom surface of the base. In another particular aspect, the legs are welded to the plate which is welded to the bottom surface of the base. In still another particular embodiment, the plate has openings for receiving the legs. The openings may be cut at an angle so that the legs extend from the base at an angle. Further, the openings may be female threaded for engaging with legs having corresponding male threadings.

In particular embodiments, the angle formed between the legs and the bottom surface of the base is an angle between about 0 degrees and about 90 degrees (e.g., about 0 degrees, 5 degrees, 10 degrees, 15 degrees, 20 degrees, 25 degrees, 30 degrees, 35 degrees, 40 degrees, 45 degrees, 50 degrees, 55 degrees, 60 degrees, 65 degrees, 70 degrees, 75 degrees, 80 degrees, 85 degrees, up to about 90 degrees). As described herein, the legs may be fixed or adjustable. In embodiments where the legs are adjustable, the angle between the legs and the bottom surface of the base may be customized to fully occupy the circumference of the open hole for which the post support is being used. In a particular aspect, the angle formed between the legs and the bottom surface of the base is about 30 degrees. In another particular aspect, the angle formed between the legs and the bottom surface of the base is about 45 degrees. In yet another particular aspect, the angle formed between the legs and the bottom surface of the base is about 60 degrees, or from about 30-60 degrees.

Post Support System

As provided herein, the post support system comprises a post support as described herein and a support mount. The system described herein allows a project involving one or more posts (or similar structures) which are to be anchored within an open hole in the ground, to proceed uninterrupted while the hole is undergoing inspection for compliance with applicable construction codes. Following inspection, the post support system may be backfilled with the appropriate material (e.g., concrete, asphalt, soil, etc.).

As described herein, the support mount is a hollow frame which may be any shape (e.g., cylindrical, trapezoidal, polygonal, such as a triangular, square, rectangular, pentagonal, hexagonal, or octagonal in shape etc.) so long as the mount is able to support the post support when interfacing with a post and/or a post and its accompanying load and the mount allows the open hole to be inspected. In a more particular aspect, the support mount further comprises a lip/shelf disposed on an interior surface/wall of the mount for receiving the at least three legs of the post support. In an embodiment, the shape of the mount is substantially circular. In another embodiment, the shape of the mount is substantially square. In embodiments, the legs or feet of the legs are disposed in communication with both the interior surface of the base of the support mount (lip) and the interior surface of the sidewall of the support mount.

In a particular embodiment, the mount is substantially circular and further comprises a lip/shelf disposed on an interior surface of the mount for receiving the at least three legs of the post support. In certain aspects, the inner circumference of the circular mount is about the same as the circumference of the open hole it is being placed into. In a particular aspect, the circular mount has an inner circumference ranging from about 6 inches (i.e., 6") to about 72 inches (i.e., 72") (e.g., about 6", 7", 8", 9", 10", 11", 12", 13", 14", 15", 16", 17", 18", 19", 20", 21", 22", 23", 24", 25" 26", 27" 28", 29", 30", 32", 32", 33", 34", 35", 36", 37", 38", 39", 40", 41", 42", 43", 44", 45", 46", 47", 48", 49", 50", 51", 52", 53", 54", 55", 56", 57", 58", 59", 60", 61", 62", 63", 64", 65", 66", 67", 68", 69", 70", 71", up to about 72"). In a particular aspect, the inner circumference of the circular mount is about 47.5". In more particular aspects, the inner radius of the circular mount has an inner radius ranging from about 1 inch (i.e., 1") to about 20 inches (i.e., 20") (e.g., about 1", 2", 3", 4", 5", 6", 7", 8", 9", 10", 11", 12", 13", 14", 15", 16", 17", 18", 19", up to about 20"). In a particular aspect, the inner radius of the circular mount is about 7.55". As described herein, the dimensions (e.g., circumference, radius, etc.) of the circular mount may be fixed or adjustable. In a particular aspect, the dimensions of the circular mount are fixed. In another particular aspect the dimensions of the circular mount are adjustable.

In another particular embodiment, the mount is substantially square and further comprises a lip/shelf disposed on an interior surface of the mount for receiving the at least three legs of the post support. In certain aspects, the perimeter of the square mount is about the same as the perimeter of the open hole it is being placed into. In a particular aspect, the square mount has a perimeter ranging from about 6 inches (i.e., 6") to about 72 inches (i.e., 72") (e.g., about 6", 7", 8", 9", 10", 11", 12", 13", 14", 15", 16", 17", 18", 19", 20", 21", 22", 23", 24", 25" 26", 27" 28", 29", 30", 32", 32", 33", 34", 35", 36", 37", 38", 39", 40", 41", 42", 43", 44", 45", 46", 47", 48", 49", 50", 51", 52", 53", 54", 55", 56", 57", 58", 59", 60", 61", 62", 63", 64", 65", 66", 67", 68", 69", 70", 71", up to about 72"). In a particular aspect, the perimeter of the square mount is about 43". In more particular aspects, each side of the square mount has a length ranging from about 6 inches (i.e., 6") to about 20 inches (i.e., 20") (e.g., about 6", 7", 8", 9", 10", 11", 12", 13", 14", 15", 16", 17", 18", 19", up to about 20"). In a particular aspect, each side of the square mount has a length about 10.75".

As described herein, the dimensions (e.g., perimeter, length, etc.) of the square mount may be fixed or adjustable. In a particular aspect, the dimensions of the square mount are fixed. In another particular aspect the dimensions of the square mount are adjustable.

Figure 2:
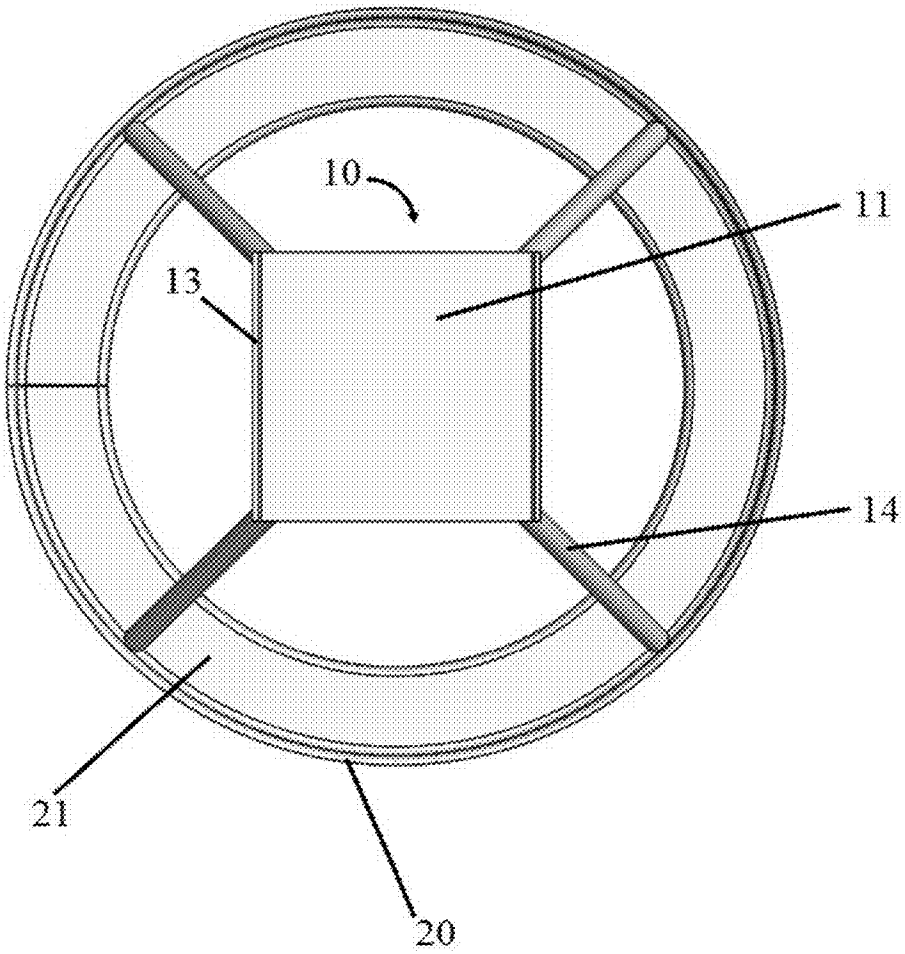
FIG. 2 is a schematic diagram illustrating a top view of the embodiment of the post support and post support system shown in FIG. 1.

As provided in the embodiment shown in FIGS. 1 and 2, the post support system (1) includes a post support (10) and a support mount (20). The post support (10) comprises a base (11) with two side walls (13) disposed on opposite sides of the base (11). In this embodiment, five through-holes (16) are specifically disposed in each wall (13) with the through-holes (16) of one wall (13) aligning with the through-holes of the opposing wall (13). Further still, the post support (10) comprises four legs (14) disposed on, in or through a plate (15). The plate (15) is further disposed on the bottom surface of the base (11). In the embodiment shown, the legs (14) are spaced about equally apart and have about the same angle relative to the surface of the plate (15) and/or the base (11) to which they are attached. The legs (14) of the post support (10) extend into and communicate with the support mount (20). As shown, the legs are in communication with the base of the support mount (lip 21) and the side wall of the support mount (the frame). As provided in FIGS. 1 and 2, the support mount (20) is a hollow circle/ring and includes a shelf/lip (21) disposed on the inner surface of the support mount (20) for receiving the legs (14) post support (10). FIG. 2 is a top view of the embodiment of the post support system (1) provided in FIG. 1.

Figures 3A, 3B, 3C, 3D, 3E, 3F:
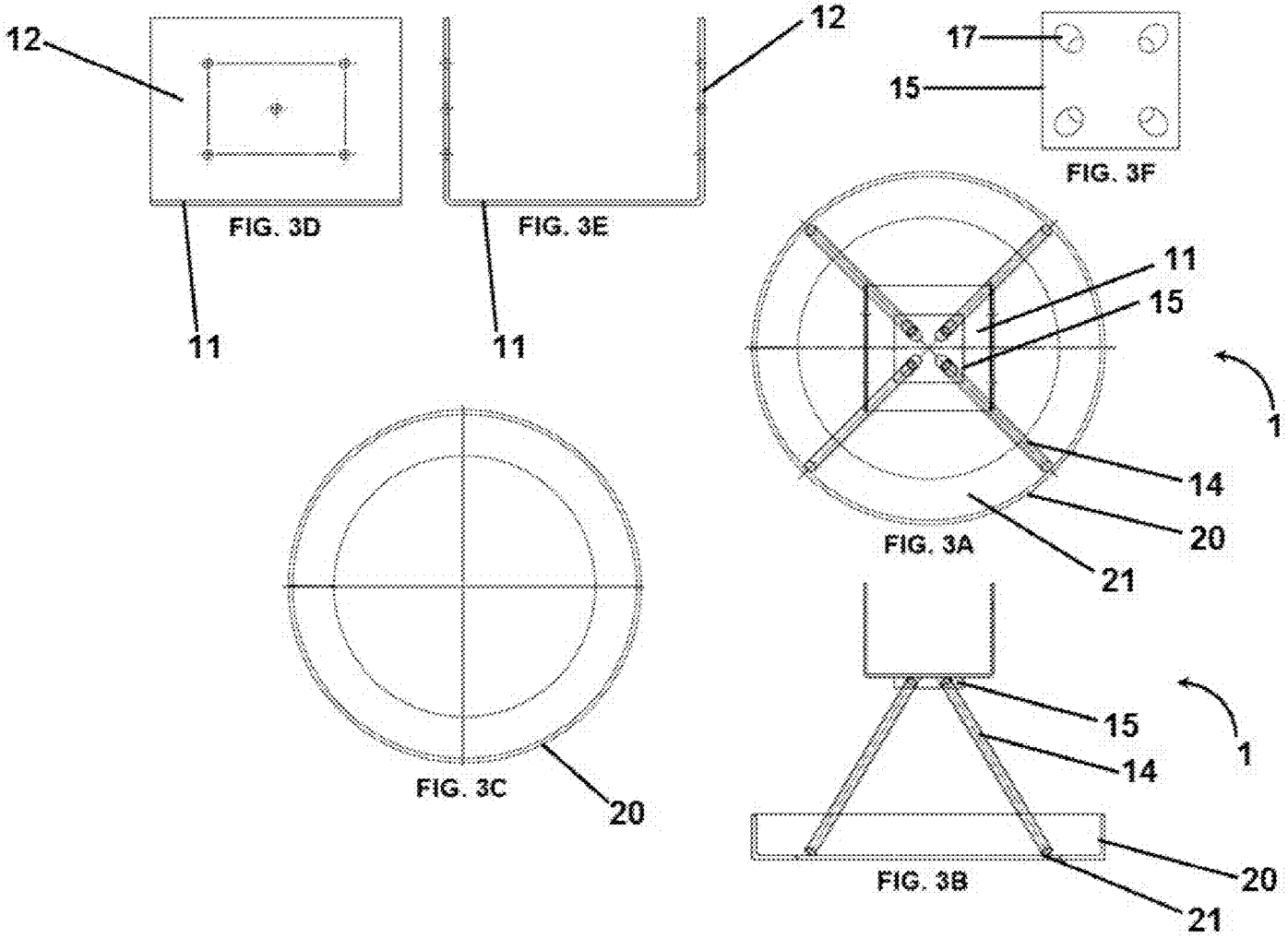
FIG. 3A is a schematic diagram showing a bottom view of the embodiment of the post support and post support system shown in FIG. 1.
FIG. 3B is a schematic diagram showing a cross-sectional view of the embodiment of the post support and post support system shown in FIG. 1.
FIG. 3C is a schematic diagram showing a top view of the embodiment of a support mount of the post support system shown in FIG. 1.
FIG. 3D is a schematic diagram showing a side view of the embodiment of the sidewalls disposed on the base of the post support shown in FIG. 1
FIG. 3E is a schematic diagram showing a front view of the embodiment of the sidewalls disposed on the base of the post support shown in FIG. 1.
FIG. 3F is a schematic diagram showing an embodiment of a plate of the post support shown in FIG. 1.

FIGS. 3A-3F show various views of the embodiment provided in FIG. 1. FIG. 3A is a bottom view of the post support system (1). FIGS. 3A and 3B show the legs (14) are disposed within openings in the plate (15) and rest on the shelf/lip (21) of the support mount (20) in communication with the sidewalls of the support mount. As shown in FIG. 3B, legs (14) can alternatively be in communication with the shelf/lip (21) and not the sidewalls. FIG. 3F shows an aspect of the plate (15) wherein the holes (17) are angled for receipt of the legs. FIG. 3C shows support mount (20). FIG. 3D is a side view of the base (11) with walls (12). FIG. 3E is a front view of the base (11) showing walls (12) disposed on opposing sides of base (11).

Figure 4:
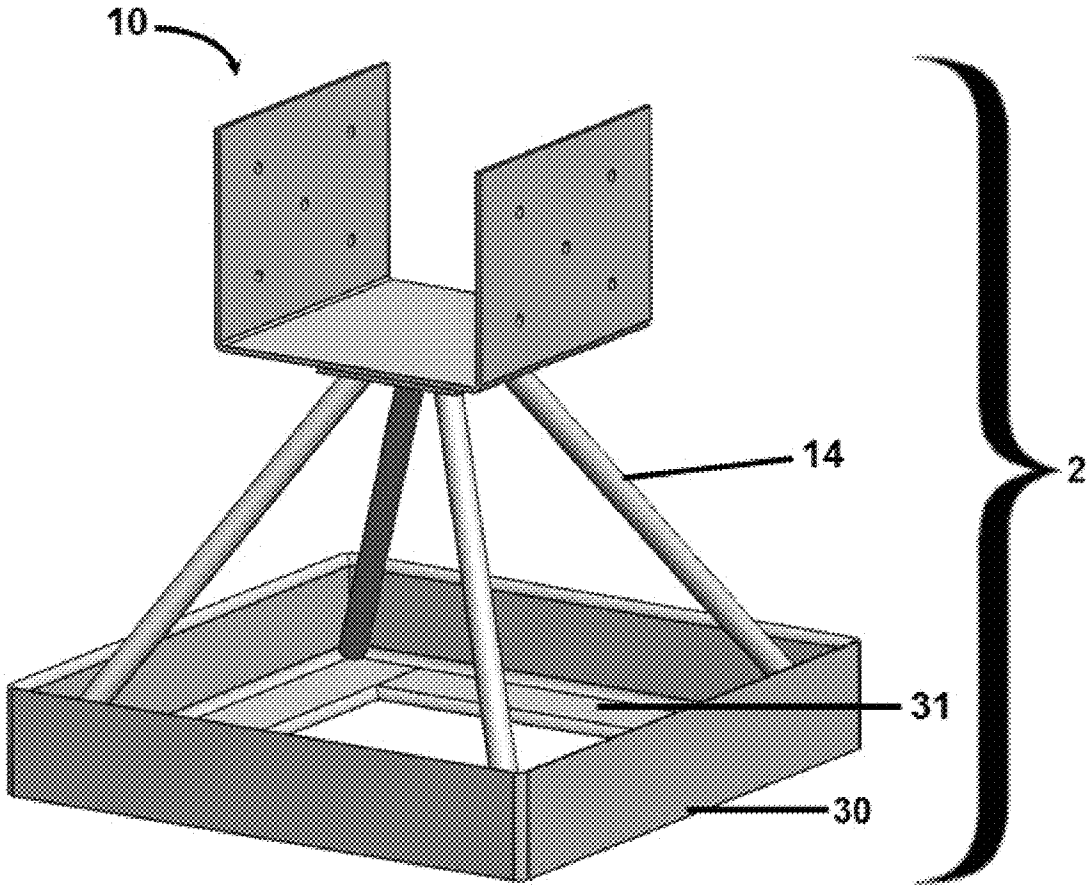
FIG. 4 is a schematic diagram illustrating an additional embodiment of the post support and post support system according to an embodiment of the disclosure.
Figure 5:
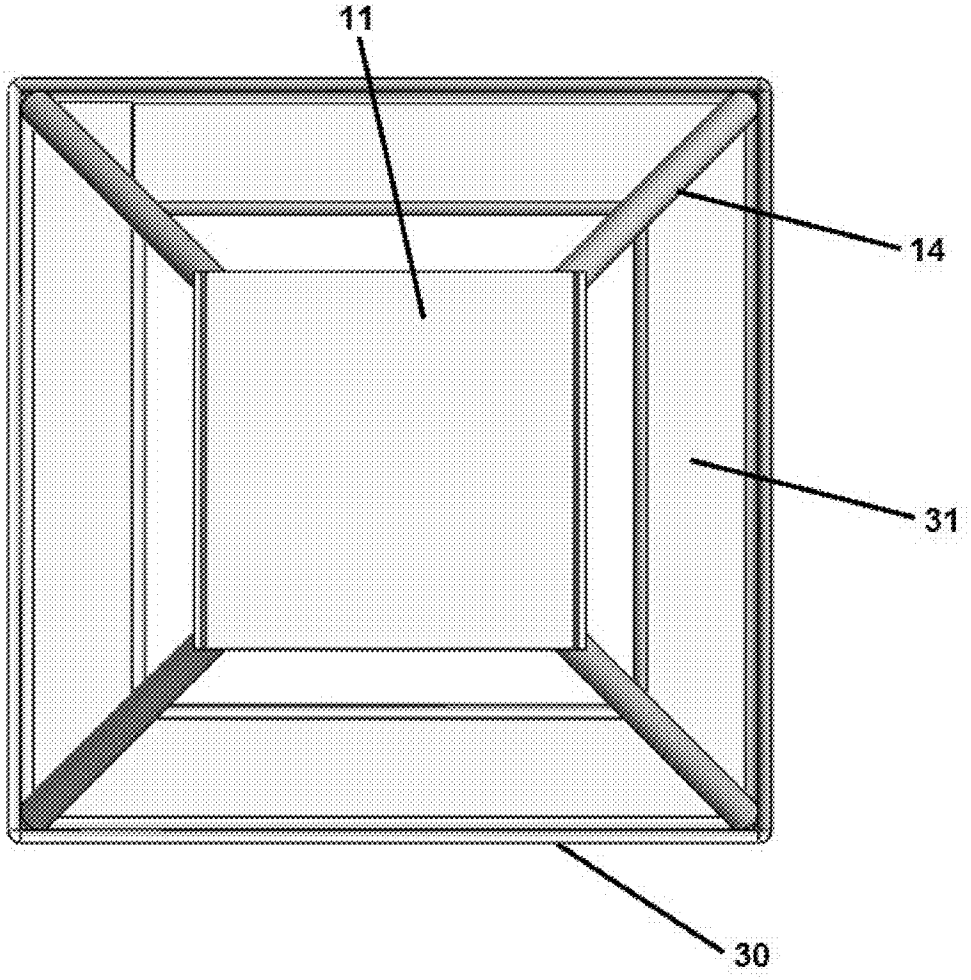
FIG. 5 is a schematic diagram illustrating a top view of the embodiment of the post support and post support system as shown in FIG. 4.

As provided in the embodiment shown in FIG. 4, the post support system (2) is similar to the system provided in FIG. 1, except that the support mount (30) is a hollow square. The support mount includes a shelf/lip (31) disposed on the inner perimeter of the support mount (30) for receiving the legs (14) of the post support (10). FIG. 5 is a top view of the embodiment of the post support system (2) provided in FIG. 4.

Figures 6A, 6B, 6C, 6D, 6E, 6F, 6G, 6H:
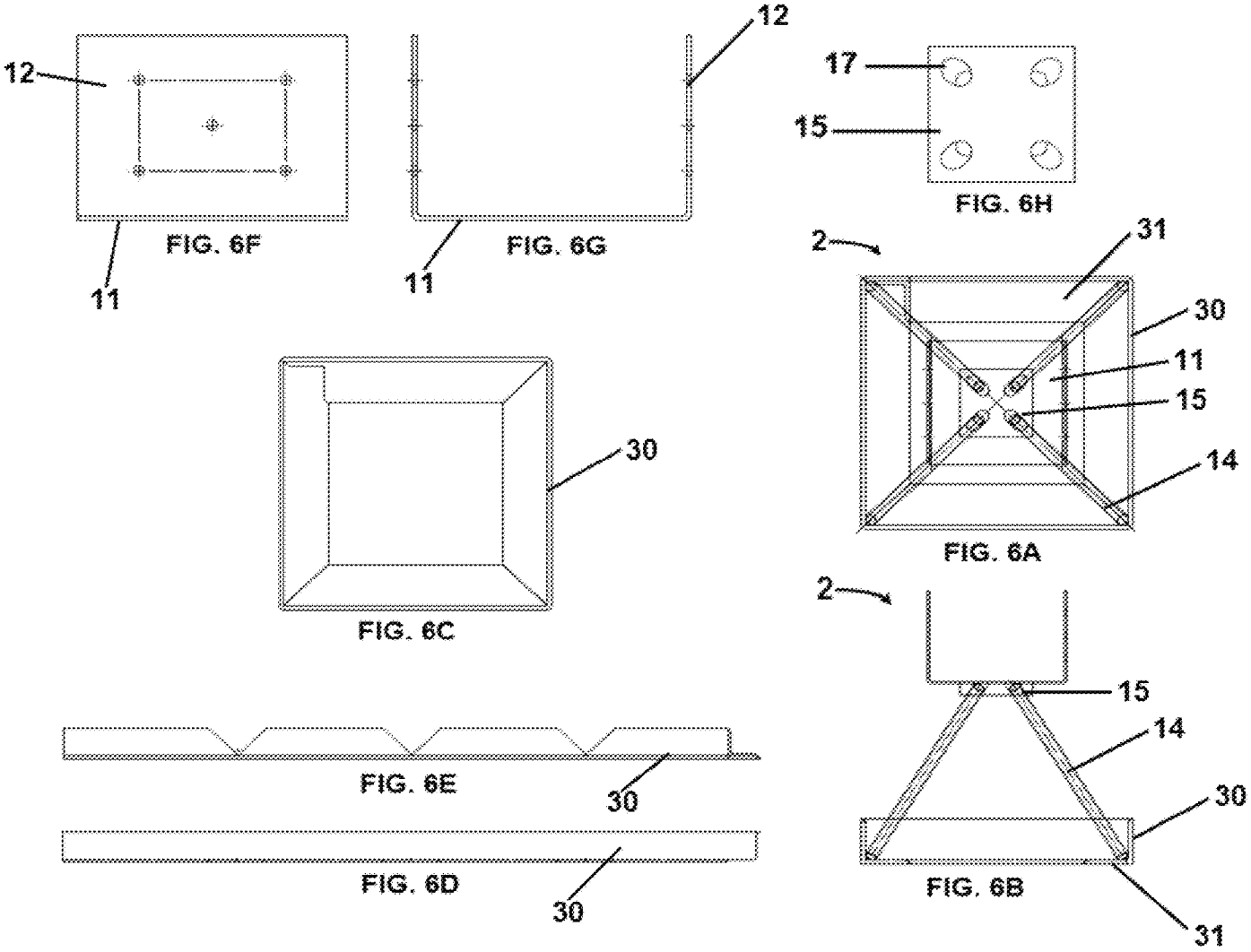
FIG. 6A is a schematic diagram showing a bottom view of the embodiment of the post support and post support system shown in FIG. 4.
FIG. 6B is a schematic diagram showing a cross-sectional view of the embodiment of the post support and post support system shown in FIG. 4.
FIG. 6C is a schematic diagram showing a top view of an embodiment of a support mount of the post support system shown in FIG. 4
FIG. 6D is a schematic diagram showing a side view of the support mount of the post support system embodiment shown in FIG. 4 and FIG. 6C prior to being configured as a support mount.
FIG. 6E is a schematic diagram showing a top view of the support mount of the post support system embodiment shown in FIG. 4 and FIG. 6C prior to being configured as a support mount.
FIG. 6F is a schematic diagram showing a side view of the sidewalls disposed on the base of the post support embodiment shown in FIG. 4.
FIG. 6G is a schematic diagram showing a front view of an embodiment of the sidewalls disposed on the base of the post support embodiment shown in FIG. 4.
FIG. 6H is a schematic diagram showing an embodiment of a plate of the post support embodiment showing in FIG. 4.

FIGS. 6A-6G show various views of the embodiment provided in FIG. 4. FIG. 6A is a bottom view of the post support system (2). FIGS. 6A and 6B show the legs (14) are disposed within openings in the plate (15), rest on the shelf/lip of the support mount (30), and are in communication with the sidewalls of the support mount. FIG. 6H shows an aspect of the plate (15) wherein the holes (17) are angled for receipt of the legs (14). FIG. 6C shows an embodiment of the support mount (30). FIG. 6D is a side view of the square support mount (30) prior to conformation into the support mount (30). FIG. 6E is a top view of FIG. 6D and shows where the support mount (30) can be contorted to provide the support mount (30) shown in FIG. 6C. FIG. 6F is a side view of the base (11) with walls (12). FIG. 6G is a front view of the base (11) showing walls (12) disposed on opposing sides of base (11).

The post support system can be used in a method of construction as follows. The horizontal frame of a structure, such as the band of a deck, may be built above ground. A hole adapted to receive a post for supporting the band of the deck may be excavated below the band of the deck. The hole may be prepared by placing a layer of gravel at the bottom of the hole. A post support system of the invention may be placed in the hole. A length of a post may be measured and cut so that it fits between the band of the deck and the post support system. The post may be installed so that a first end of the post supports and is in communication with the band of the deck and a second end of the post is supported by and in communication with the post support system. The post may be attached to one or both of the side walls of the base of the post support system using fasteners (such as a wood screw or nail) and one or more throughholes in the sidewalls. A concrete footing may be poured into the hole around the post support system to become the permanent footing (post support system and concrete) on which the posts bears. The side walls which attach to the post also provide uplift protection. An advantage of this system is that the construction project (here, building of the deck) can continue with or without the concrete footing(s) being poured, such that the concrete footings can be installed at any time during the construction project, for example, even after the deck is built.

The present disclosure has been described with reference to particular embodiments having various features. In light of the disclosure provided above, it will be apparent to those skilled in the art that various modifications and variations can be made in the practice of the present invention without departing from the scope or spirit of the invention. One skilled in the art will recognize that the disclosed features may be used singularly, in any combination, or omitted based on the requirements and specifications of a given application or design. When an embodiment refers to "comprising" certain features, it is to be understood that the embodiments can alternatively "consist of" or "consist essentially of" any one or more of the features. Other embodiments of the invention will be apparent to those skilled in the art from consideration of the specification and practice of the invention. It is noted in particular that where a range of values is provided in this specification, each value between the upper and lower limits of that range is also specifically disclosed.

The upper and lower limits of these smaller ranges may independently be included or excluded in the range as well. The singular forms "a," "an," and "the" include plural referents unless the context clearly dictates otherwise. It is intended that the specification and examples be considered as exemplary in nature and that variations that do not depart from the essence of the invention fall within the scope of the invention. Further, all of the references cited in this disclosure are each individually incorporated by reference herein in their entireties and as such are intended to provide an efficient way of supplementing the enabling disclosure of this invention as well as provide background detailing the level of ordinary skill in the art.

The invention claimed is:

1. A post support comprising:

a base with a base plate perimeter, a top surface and a bottom surface;

two walls opposing one another and disposed about 90 degrees relative to the top surface of the base, each of the two walls disposed along the base plate perimeter and spaced a first distance apart;

a support plate disposed on the bottom surface of the base;

at least three legs, each leg with a first leg end terminating at and in direct communication with the bottom surface of the base, wherein the first ends of the legs are disposed within an area defined by the base plate perimeter and the first ends of the legs are disposed a second distance apart, which second distance is smaller than the first distance.

2. The post support of claim 1 further comprising a support mount for receiving a second leg end of each of the at least three legs of the post support.

3. The post support of claim 2, wherein each of the walls comprises at least one through-hole for securing a post to the post support.

4. The post support of claim 1, wherein each of the at least three legs comprises at least one foot configured for communication with a surface on which the post support is placed during use.

5. The post support of claim 1, wherein the support plate has a smaller perimeter than that of the base.

6. The post support of claim 1, wherein the first leg end of each of the at least three legs is in direct communication with the support plate.

7. The post support of claim 1, wherein the post support has four legs.

8. The post support of claim 1, wherein the support plate has apertures which each receive the first leg end of the at least three legs at an acute angle relative to a bottom surface of the support plate.

9. A post support system comprising:

a U-shaped post support comprising:

a base plate with a base plate perimeter, a top surface and a bottom surface; and at least two walls opposing one another, each disposed along the base plate perimeter and extending upwardly from the top surface of the base plate and spaced apart from one another at a selected wall spacing distance;

a support plate disposed on the bottom surface of the base plate;

at least three legs; and a support mount for receiving the at least three legs of the post support;

wherein a first end of each of the at least three legs is disposed in communication with the bottom surface of the base plate and within an area defined by the base plate perimeter, wherein the first ends of the at least three legs are disposed apart from one another at a distance smaller than the selected wall spacing distance; and wherein a second end of each of the at least three legs is disposed in communication with the support mount.

10. The post support system of claim 9, wherein the at least two walls comprise at least one through-hole.

11. The post support system of claim 9, wherein the first end of each of the at least three legs is in communication with the support plate.

12. The post support system of claim 9, wherein the first end of each of the at least three legs is in communication with an aperture of the support plate.

13. The post support system of claim 9, wherein the at least three legs are spaced equidistantly relative to one another.

14. The post support system of claim 9, wherein the at least two walls are each disposed at an angle of between 30-120 degrees relative to the top surface of the base plate.

15. The post support system of claim 9, wherein the support mount has a lip and the second end of each of the at least three legs is in communication with the lip.

16. The post support system of claim 15, wherein the support mount comprises a side wall and the second end of each of the at least three legs is in communication with the side wall of the support mount.

17. The post support system of claim 9, wherein the support plate has apertures which each receive the first leg end of the at least three legs at an acute angle relative to a bottom surface of the support plate.

18. A post support system comprising:

a post support comprising:

a base with a base perimeter;

at least two walls opposing one another on one side of the base along the base perimeter, extending upwardly from that side of the base, and spaced apart from one another at a selected wall spacing distance;

a plate with apertures on an opposing side of the base; and at least three legs, each with a first end disposed in communication with one of the apertures of the plate, wherein the first end of each of the at least three legs is disposed within an area defined by the base perimeter and the first ends of the at least three legs are disposed at a distance smaller than the selected wall spacing distance; and a support mount with a lip;

wherein each leg has a second end disposed in communication with the lip of the support mount.

* * * * *